US007052384B2

(12) United States Patent
Wolf et al.

(10) Patent No.: US 7,052,384 B2
(45) Date of Patent: May 30, 2006

(54) MANUAL MACHINE TOOL WITH SPINDLE STOP

(75) Inventors: Andreas Wolf, Stuttgart (DE); Sinisa Andrasic, Musberg (DE)

(73) Assignee: Robert Bosch GmbH, Stuttgart (DE)

( * ) Notice: Subject to any disclaimer, the term of this patent is extended or adjusted under 35 U.S.C. 154(b) by 374 days.

(21) Appl. No.: 10/450,090

(22) PCT Filed: Sep. 10, 2002

(86) PCT No.: PCT/DE02/03358

§ 371 (c)(1),
(2), (4) Date: Jun. 10, 2003

(87) PCT Pub. No.: WO03/049907

PCT Pub. Date: Jun. 19, 2003

(65) Prior Publication Data

US 2004/0069513 A1 Apr. 15, 2004

(30) Foreign Application Priority Data

Dec. 6, 2001 (DE) ..... 201 19 835 U

(51) Int. Cl.
*B24B 23/00* (2006.01)

(52) U.S. Cl. ..... 451/358; 310/50; 403/324

(58) Field of Classification Search ..... 451/358, 451/359, 344; 310/50, 75 R; 403/324, 328
See application file for complete search history.

(56) References Cited

U.S. PATENT DOCUMENTS

| | | | | |
|---|---|---|---|---|
| 4,179,632 | A * | 12/1979 | Harvell | 310/50 |
| 4,467,896 | A * | 8/1984 | Sauerwein et al. | 188/69 |
| 5,263,283 | A * | 11/1993 | Rudolf et al. | 451/344 |
| 5,464,365 | A * | 11/1995 | Kirn | 451/344 |
| 2002/0130007 | A1 * | 9/2002 | Nakamura et al. | 192/38 |
| 2002/0151262 | A1 * | 10/2002 | Berger et al. | 451/358 |

FOREIGN PATENT DOCUMENTS

| | | |
|---|---|---|
| DE | 28 16 398 A | 10/1979 |
| DE | 31 20 899 A | 12/1982 |
| EP | 0 691 180 A | 1/1996 |

* cited by examiner

*Primary Examiner*—Jacob K. Ackun, Jr.
(74) *Attorney, Agent, or Firm*—Michael J. Striker

(57) ABSTRACT

A hand power tool (10) with a housing (12) that accommodates a turnably driveable driven shaft (20) on which a machining, in particular disk-shaped, replaceably clampable tool is mounted, whereby the driven shaft (20) is capable of being stopped by means of an axially displaceable locking pin (36) that extends through a through hole of the housing (12) and is capable of being operated from the outside, said hand power tool being made more robust and more cost-effective to produce due to the fact that the diameter-length ratio of the through hole (35) and the locking pin (36) is less than 1.8 and, in particular, equal to 1.5.

8 Claims, 2 Drawing Sheets

MANUAL MACHINE TOOL WITH SPINDLE STOP

BACKGROUND OF THE INVENTION

The present invention is based on a hand power tool comprising a housing and a driven shaft mounted in the housing so as to be rotatable but with a spindle stop that is operable to prevent the driven shaft from rotating.

Angle grinders and hand-operated circular saws are examples of known hand power tools with spindle stop. With said machines, in order to replace the tool, the driven shaft must be prevented from rotating, so that the locking screw holding the saw blade or the grinding disk in place on the driven shaft can be loosened. The spindle stop device absorbs the torque produced when the bolt is loosened.

Cylindrical locking pins typically serve as spindle stop, said cylindrical locking pins being displaced in the longitudinal direction and thereby engaging via one end with positive engagement in a part which is coupled with the driven shaft in torsion-resistant fashion, or engaging directly in the driven shaft.

The locking pins, which are supported in longitudinally displaceable fashion, pass through the housing of the hand power tools. The housing is therefore subject to a great deal of wear in the region where the locking pin passes through, e.g. when the spindle stop is actuated while the driven shaft is turning, or when an excessively high amount of release torque is applied to a retaining nut of the saw blade or grinding disk that has rusted tight. This results in an increasing amount of play between the locking pin and the guide sleeve, and it impairs the function of the spindle stop. In addition, the guide sleeve for guiding the locking pin longitudinally in the gearbox housing can become loose and expand. This can result in gear lubricant leaking out and/or dust entering along the locking pin, so that the outside of the housing becomes dirty and the moving parts inside the housing are not adequately lubricated, due to lack of lubricant.

SUMMARY OF THE INVENTION

It is an object of the present invention to provide a power hand tool of the above-described kind, which does not have the above-described disadvantages including a spindle stop structure through which lubricant can leak.

The power tool according to the invention comprises a housing; a turnably driveable driven shaft for a releasably mountable tool, which is arranged in the housing; and means for stopping the driven shaft, which comprises en axially displaceable locking pin extending and fitting in a sliding guide provided In the housing so that the locking pin is manually operable from outside of the housing and an O-ring installed in an annular groove around the locking pin and arranged in a center part of the looking pin, so that lubricant cannot leak through the sliding guide to the outside of the housing from a housing interior and wherein a diameter-length ratio of the sliding guide and of the locking pin fitting in it is less than 1.8, preferably between 1.3 and 1.8, and especially preferably equal to 1.5.

As a result of the configuration of the power hand tool according to the invention, it becomes more cost-effective to fabricate, because a guide sleeve can be eliminated in the region where the locking pin passes through the housing, making the longitudinal guide of the locking pin more impervious and robust. Additionally, the configuration of the locking pin provides a better safeguard against lubricant escaping from the housing and against dust and contamination from entering the housing from the outside.

Due to the fact that the locking pin has a larger diameter and the through hole encompasses it directly and guides it, surface pressure can be reduced and, when a guide sleeve is eliminated, imperviousness can be enhanced.

Due to the fact that an O-ring is installed on the locking pin, nearly in the center, in an annular groove, imperviousness is ensured between the through hole and/or the sliding guide and the locking pin during operation of the spindle stop, even when a maximum load is placed on the locking pin.

Due to the fact that a collar-like, radial extension is located on the locking pin in front of the region of said locking pin which is capable of engaging in the driven shaft with a positive connection, the end face of which said radial extension bears against the wall of the gearbox housing when the locking pin is in the rest position, an axial imperviousness is created that prevents lubricant from escaping from the housing to the outside.

Due to the fact that the locking pin transitions into a neck on its upper end, where a cap capable of being installed and serving as a button is located, the spindle stop is easier to install and remove, and it is easy to operate.

Due to the fact that a spring is installed on the locking pin between the cap serving as a button and the part of the stepped bore having the larger diameter, the locking pin is held reliably in its rest position, and the collar-like radial extension is held in the stop position on the inner wall of the housing in its sealing position.

Due to the fact that the neck of the locking pin has a lock-in groove, and the cap serving as button has a lock-in cylinder, installation of the cap on the locking pin is particularly simple and robust.

BRIEF DESCRIPTION OF THE DRAWING

The invention is explained hereinbelow with reference to exemplary embodiments and accompanying drawings.

DESCRIPTION OF THE PREFERRED EMBODIMENTS

Figure 1:
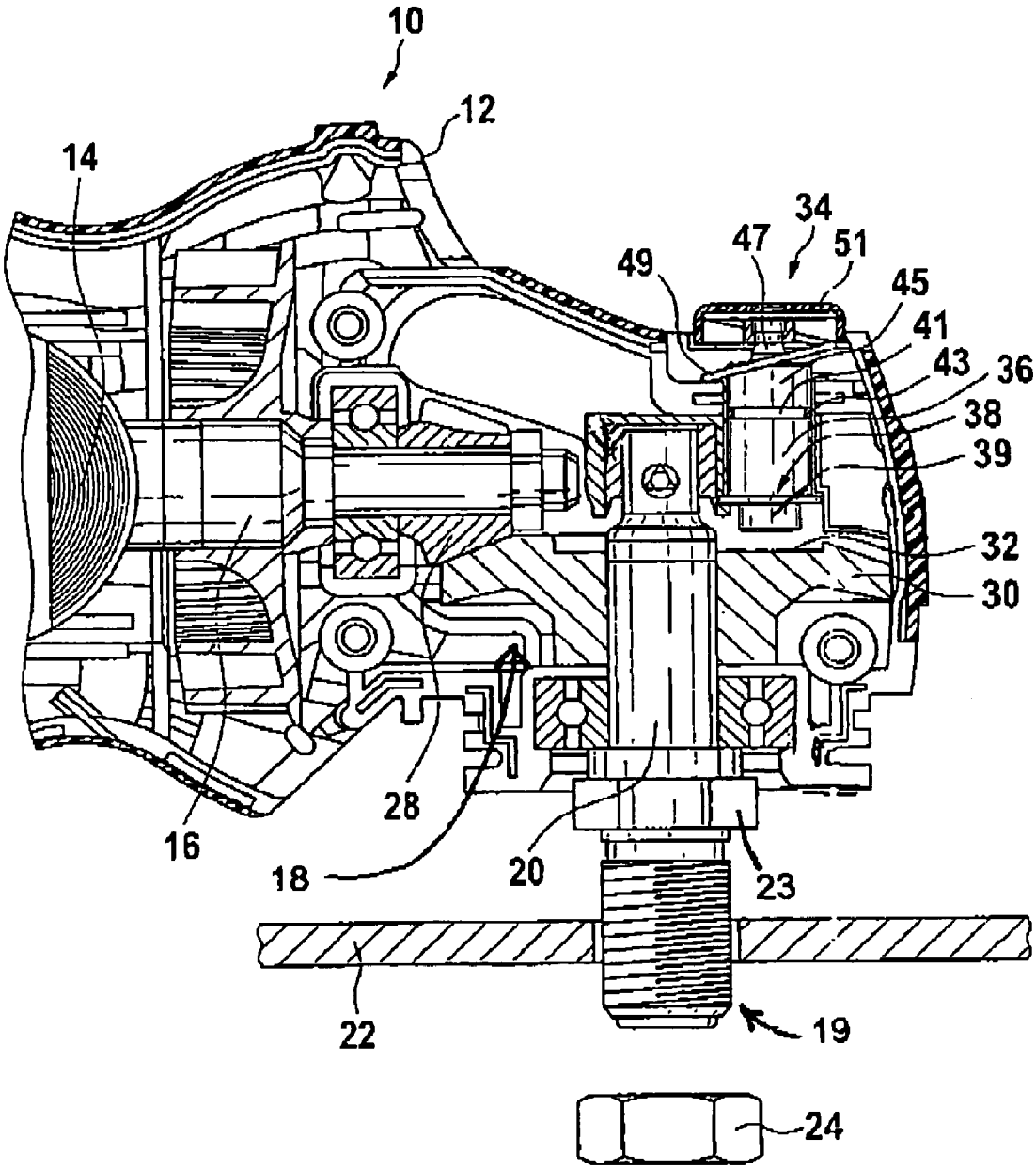
FIG. 1 shows a partial longitudinal sectional view of a hand power tool according to the invention.
Figure 2:
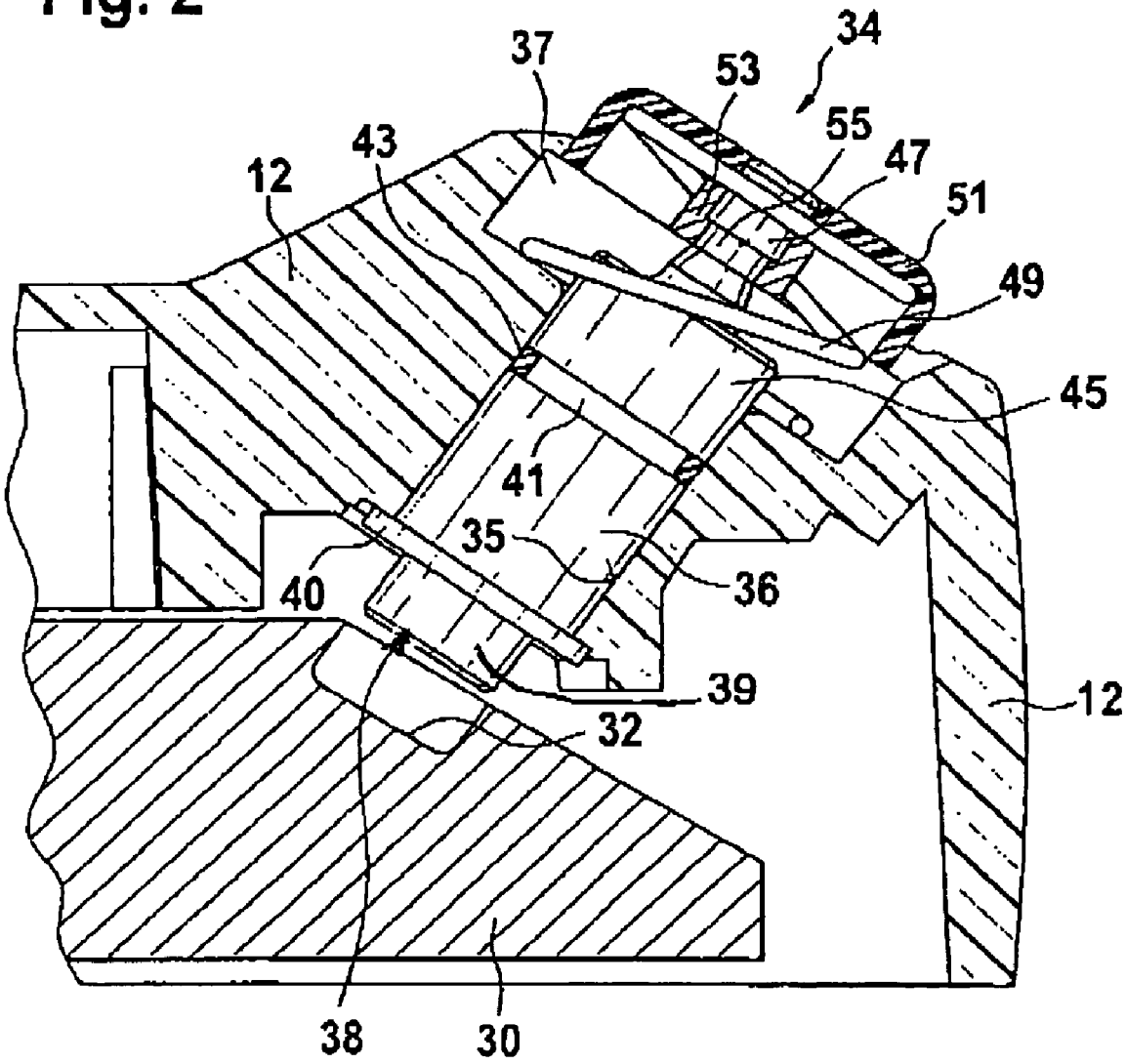
FIG. 2 shows an enlarged section of a further exemplary embodiment of a hand power tool with spindle stop.

FIG. 1 shows a partial longitudinal sectional view of a hand power tool 10 configured as an angle grinder. In its posterior region, a housing 12 houses an electric motor 14 with a motor shaft 16, and it contains an angular gear 18. The angular gear 18 is composed of a grinding spindle 20, the free end of which projects out of the housing 12. A thread, which is not described in greater detail, is located thereon, onto which said thread a nut 24 can be screwed. Said nut holds a grinding disk 22 in place, said grinding disk having been placed over the free end 19 of the grinding spindle via its hole, which is not described in further detail. The grinding disk 22 is thereby clamped axially between a collar 23 of the driven shaft 20 and the nut 24.

The angular gear 18 is composed of a small bevel gear pinion 28—which is situated on the end of the motor shaft 16 in torsion-resistant fashion—and a large bevel gear 30. The bevel gear pinion 28 engages in the bevel gear 30, which is situated on the driven shaft 20 in torsion-resistant fashion. The bevel gear 30 comprises at least one recess 32 on its top side, in which a locking pin 36 fits, said locking pin belonging to a spindle stop 34. The locking pin 36 is supported in a longitudinal guide in longitudinally displaceable fashion by virtue of the fact that it passes between the walls of the housing 12 and projects outwardly, and a larger region of said locking pin extends into the interior of the housing 12. The sliding guide 35 is configured as a stepped bore 37, the larger diameter of which is directed outwardly, and the smaller diameter of which encompasses the cylindrical locking pin 36 in sealing fashion.

The locking pin 36 has a peg 39 on its lower end 38 for engaging in one of the recesses 32 of the bevel gear 30.

The peg 39 has a smaller diameter than the rest of the locking pin 36. A radially projecting, disk-like sealing collar 40 is attached at the transitional region between the peg 39 and the locking pin 36. Said sealing collar bears axially against the inner wall of the housing 12 and therefore extends past the mouth of the sliding guide 35 and/or the stepped bore 37.

An annular groove 41 Is located in the locking pin 36, nearly in the center, in which said annular groove an O-ring 43 is inserted. Said O-ring is situated between the locking pin 36 and the sliding guide 35 and acts as a seal, preventing lubricant from escaping from the housing 12 when the locking pin 36 is subjected to high loads when It engages in the recess 32 when the spindle stop 34 is operated. A reliable seal Is therefore attained between the sliding guide 35 and the locking pin 36.

In its upper region, the locking pin 36 transitions from shoulders 45 into a neck 47. A cap serving as a button 51 is placed on the neck 47, which said cap slips over the neck 47 with a lock-in cylinder 53 and locks in place in the lock-in groove 55 of said neck. A compression spring 49 is supported between the button 51 and the bottom of the stepped bore 37 having the larger diameter. Said compression spring is preloaded and tries to push the locking pin 36 outwardly, so that its sealing collar 40 bears again the inner wall of the housing 12 when in the rest position.

The locking pin 36 covers a distance of nearly 5 mm before the spindle stop 34 is activated. Said locking pin then engages completely with its peg 39 in one of the recesses 32 of the bevel gear 30.

The diameter-length ratio of the locking pin is between 1.8 and 1.3. The radial surface pressure and the stress placed on the housing 12 in the region of the sliding guide 35 is therefore less than that of conventional spindle stops.

What is claimed is:

1. A power tool comprising a housing (12);

a turnably driveable driven shaft (20) for a releasably attachable tool, said driven shaft (20) being arranged in the housing;

means (34) for stopping the driven shaft (20), said means for stopping comprising an axially displaceable locking pin (36) extending and fitting in a sliding guide (35) provided in the housing (12) so that said locking pin (36) is operable from outside of the housing and an O-ring (43) installed in an annular groove (41) around the locking pin (36) and arranged approximately centrally on the locking pin, so that lubricant in an interior of the housing does not leak through the sliding guide (35) to the outside of the housing;

wherein a diameter-length ratio of the sliding guide and of the locking pin fitting in the sliding guide is less than 1.8.

2. The power tool as defined in claim 1, wherein said locking pin (36) has a peg (39) on a lower end (38) thereof, said peg (39) has a smeller diameter than a remaining portion of said locking pin (36) and a disk-like sealing collar (40) is arranged between said peg (39) and said remaining portion of said locking pin SO as to bear on an inner wall of said housing when said means for stopping is not operated to stop the driven shaft.

3. The power tool as defined in claim 2, wherein said locking pin (36) has a cap (51) on an upper end thereof and a compression spring (47) arranged between the cap (51) and the housing (12), so that said compression spring (47) urges said locking pin (36) outward and presses said disk-like sealing collar (40) against said inner wall of said housing.

4. The power tool as defined in claim 3, wherein said sliding guide (35) is provided by a through-going bore hole (37) through the housing, which is stepped so as to have a larger section open to the outside and the cap (51) can be pushed into the larger section against the action of the compression spring (47).

5. The power tool as defined in claim 2, wherein said driven shaft (20) is attached to a bevel gear (30) for driving the driven shaft, said bevel gear (30) is provided with a recess (32) and said peg (39) is engageable in said recess (32) provided in said bevel gear (30), in order to stop rotation of the driven shaft.

6. The power tool as defined in claim 1, wherein said diameter-length ratio is equal to 1.5.

7. The power tool as defined in claim 1, wherein the releasably attachable tool is a disk-shaped replaceable clampable tool (22).

8. The power tool as defined in claim 7, consisting of an angle grinder.

* * * * *